US005667539A

United States Patent [19]

Jackson et al.

[11] Patent Number: 5,667,539

[45] Date of Patent: Sep. 16, 1997

[54] OLEAGINOUS COMPOSITIONS

[75] Inventors: Graham Jackson, Reading; Rachel Evelyn Mary Kenward, Faringdon; Barbara Catherine Brooke, Newbury, all of United Kingdom

[73] Assignee: Exxon Chemical Patents Inc., Linden, N.J.

[21] Appl. No.: 698,156

[22] Filed: Aug. 7, 1996

Related U.S. Application Data

[63] Continuation of Ser. No. 392,967, filed as PCT/EP93/02739, Oct. 5, 1993, abandoned.

[30] Foreign Application Priority Data

Oct. 5, 1992 [GB] United Kingdom ..... 9220876

[51] Int. Cl.[6] ..... C10L 1/24; C10L 1/22

[52] U.S. Cl. ..... 44/384; 44/384; 44/399; 44/408; 44/410; 44/413; 44/415; 44/422; 44/424

[58] Field of Search ..... 44/349, 384, 408, 44/410, 413, 415, 422, 424

[56] References Cited

U.S. PATENT DOCUMENTS

| | | | |
|---|---|---|---|
| 2,401,957 | 6/1946 | Pedersen et al. | 44/424 |
| 2,570,377 | 10/1951 | Revukas | 252/344 |
| 3,060,210 | 10/1962 | De Groote et al. | 260/404.5 |
| 3,115,466 | 12/1963 | Orloff et al. | 44/424 |
| 3,208,859 | 9/1965 | Coffield | 44/424 |
| 3,305,483 | 2/1967 | Coffield | 44/424 |
| 3,649,229 | 3/1972 | Otto | 44/424 |
| 3,980,569 | 9/1976 | Pindar et al. | 44/424 |
| 4,058,371 | 11/1977 | Ilnyckyj | 44/384 |
| 4,071,327 | 1/1978 | Dorer, Jr. | 44/408 |
| 4,142,980 | 3/1979 | Karll et al. | 252/51.5 A |
| 4,396,517 | 8/1983 | Gemmill, Jr. et al. | 252/51.5 R |
| 4,405,338 | 9/1983 | Jenkins, Jr. et al. | 44/424 |
| 4,481,013 | 11/1984 | Tack et al. | 44/399 |
| 4,490,155 | 12/1984 | Kaufman | 44/71 |
| 4,508,541 | 4/1985 | Kaufman | 44/410 |
| 5,039,310 | 8/1991 | Blain et al. | 44/424 |

FOREIGN PATENT DOCUMENTS

| | | |
|---|---|---|
| 517356 | 12/1992 | European Pat. Off. . |
| 2153841 | 8/1985 | United Kingdom . |
| 9116297 | 10/1991 | WIPO . |

*Primary Examiner*—Jerry D. Johnson
*Attorney, Agent, or Firm*—John T. Mahon

[57] ABSTRACT

Compounds of the formula I below are useful as additives in oleaginous compositions:

I wherein B represents an aromatic system, A represents a hydrocarbyl group, $R^1$ and $R^2$ are the same or are different and each independently is an aliphatic hydrocarbyl group containing 10–40 carbon atoms, provided that one of $R^1$ and $R^2$ may represent hydrogen; z is at least 1 and wherein the aromatic system carries at least one substituent group which is an activating group for the ring system or a derivative of an activating group.

9 Claims, No Drawings

OLEAGINOUS COMPOSITIONS

This is a continuation of application Ser. No. 392,967, filed May 17, 1995, now abandoned, which is a 371 of PCT/EP93/02739 filed Oct. 5, 1993.

The invention relates to oil soluble additives useful for oleaginous compositions such crude oil, lubricating oil and fuel oil compositions and novel compounds comprising such additives.

Oleaginous materials such as crude oils, lubricating oils, heating oils and other distillate petroleum fuels, for example, diesel fuels, contain alkanes that at low temperature tend to precipitate as large crystals of wax in such a way as to form a gel structure which causes the fuel or oil to lose its ability to flow. The lowest temperature at which the crude oil, lubricating oil or fuel oil will still flow is known as the pour point. The low temperature properties of oleaginous materials are often referred to as cold flow properties and additives for oleaginous compositions which have an effect on and improve these properties are known generically as cold flow additives or improvers.

In the case of fuels, as the temperature of the fuel falls and approaches the pour point, difficulties arise in transporting the fuel through lines and pumps. Further, the wax crystals tend to plug fuel lines, screens and filters at temperatures above the pour point. These problems are well recognized in the art, and various additives have been proposed, many of which are in commercial use, for depressing the pour point of fuel oils. Similarly, other additives have been proposed and are in commercial use, for reducing the size and changing the shape of the wax crystals that do form. Smaller size crystals are naturally desirable since they are less likely to clog a filter; certain additives inhibit the wax from crystallizing as platelets and cause it to adopt an acicular habit, the resulting needles being more likely to pass through a filter than are platelets. The additives may also have the effect of retaining in suspension in the fuel the crystals that have formed, the resulting reduced settling also assisting in prevention of blockages.

Additives for oleaginous materials such as crude oils, lubricating oils and fuel oils may have a number of different effects. Cloud point depressants are additives which delay the onset of crystallization of wax in the oleaginous material as the temperature decreases. Flow improvers may improve the cold flow properties of an oleaginous material with or without having any effect as a cloud point depressant. Additives which change the size and shape of wax crystals are sometimes referred to as wax crystal modifiers. Additives which have the effect of retaining wax crystals in suspension are sometimes referred to as wax antisettling aids.

There are many disclosures in the art relating to the above described additives. Exemplary of the patent literature which relates to oil soluble additives which are Mannich base additives or are additives derived from Mannich bases are the following: U.S. Pat. No. 3,442,808, U.S. Pat. No. 3,539,633, U.S. Pat. No. 3,649,229, U.S. Pat. No. 3,741,896, U.S. Pat. No. 3,798,165, U.S. Pat. No. 4,354,950, U.S. Pat. No. 4,585,566 and EP 0 304 175 A1.

In addition to the above prior art on oil soluble additives EP 0 469 203 A1 discloses Mannich condensates of a substituted hydroxyaromatic compound and an alkylamine containing internal alkoxy groups which are useful as surfactants, corrosion inhibitors, water repellant agents, paint adhesion promoters and for the preparation of surfactants.

GB 1 432 751, GB 1 454 345 and GB 1 457 932 disclose Mannich bases derived from bisphenolic compounds and their use in polymer synthesis and polymeric coatings.

JP 58 210 919A and JP 58 153 506A disclose polymeric products prepared from Mannich bases derived from bisphenol and epihalohydrin.

The present invention is concerned with the use of compounds such as Mannich bases as additives in oleaginous compositions.

A first aspect of this invention is:

A composition comprising an oleaginous material and, as an additive, a compound having the formula I, or a salt thereof:

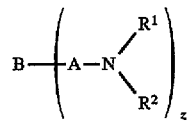

I wherein B represents an aromatic system. A represents a hydrocarbyl group, $R^1$ and $R^2$ are the same or are different and each independently is an aliphatic hydrocarbyl group containing 10–40 carbon atoms provided that one of $R^1$ and $R^2$ may represent a hydrogen atom, z is at least 1 and wherein the aromatic system carries at least one substituent group which is an activating group for the ring system or a derivative of an activating group.

By the term hydrocarbyl in this specification is meant an organic moiety which is composed of hydrogen and carbon, which is bonded to the rest of the molecule by a carbon atom or atoms and which unless the context states otherwise, may be aliphatic, including alicyclic, aromatic or a combination thereof. It may be substituted or unsubstituted, alkyl, aryl or alkaryl and may optionally contain unsaturation or heteroatoms such as O, N or S, provided that such heteroatoms are insufficient to alter the essentially hydrocarbyl nature of the group. It is preferred that A is an aliphatic hydrocarbyl group and more preferably that A is a methylene group.

The term aromatic system is meant to include aromatic homocyclic, heterocyclic or fused polycyclic assemblies, or a system where two or more such cyclic assemblies are joined to one another and in which the cyclic assemblies may be the same or different. Where there are two or more cyclic assemblies and Z is 2 or more the —(A—$NR^1R^2$) groups present may be in the same or different assemblies. It is preferred that the aromatic system is a ring system based on benzene rings.

The ring atoms in the aromatic system are preferably carbon atoms but may for example include one or more heteroatoms such as N, S, or O in the system in which case the compound is a heterocyclic compound.

Examples of such polycyclic assemblies include (a) condensed benzene structures such as naphthalene, anthracene, phenanthrene, and pyrene;

(b) condensed ring structures where none of or not all of the rings are benzene such as azulene, indene, hydroindene, fluorene, and diphenylene;

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine; and (e) bisaromatic systems wherein the rings are linked by one or more divalent groups such as for example bisphenol A or fluorescein.

By the term activating group is meant any group, other than a substituent aliphatic hydrocarbyl group which activates the aromatic system to substitution reactions such as electrophilic substitution, nucleophilic substitution or to the Mannich reaction. The activating group may be a nonsubstituent group such as functionality which is within the aromatic system as in for example heterocyclic compounds such as indole. The activating group is located at least within or on each of the rings of the aromatic system which are substituted with an —(A—$NR^1R^2$) group. It is preferred that the activating group is a group which is on the ring system as opposed to being within the aromatic system. Desirably the activating group or groups activate the aromatic system to electrophilic substitution or to the Mannich reaction, most preferably to the Mannich reaction. It is preferred that the activating group activates the aromatic system in the ortho or para position relative to itself. The preferred activating group is a hydroxyl group. The preferred activated aromatic system is a hydroxy aromatic system. By the term derivative of an activating group is meant any group which can be produced by the reaction of the activating group. For example when the activating group is a hydroxyl group one derivative would be an —O—C(O)—$CH_3$ group produced by reaction of the hydroxyl group with for example acetic anhydride. There may be more than one activating group or a derivative of an activating group on or in the aromatic system; they may be in or on the same or different rings. There may also be other substituents present which are in or on the aromatic system and are not activating groups or derivatives of activating groups.

Each aliphatic hydrocarbyl group constituting $R^1$ and $R^2$ in the invention may for example be an alkyl or alkylene group or a mono or polyalkoxyalkyl group or aliphatic hydrocarbyl groups which contain heteroatoms such as O, N or S. Preferably each aliphatic hydrocarbyl group is a straight chain alkyl group. The number of carbon atoms in each aliphatic hydrocarbyl group is preferably 12–24, most preferably 16 to 22.

Preferably, such as when z=1, the aromatic system also carries a substituent of general formula II

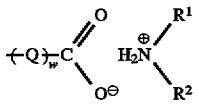

II wherein w=0 or 1; Q represents A; and $R^1$ and $R^2$ have the meaning as given above. It is preferred that W=0 and that there is only one additional substituent of the above general formula II. The additional substituent of general formula II may also be present in the aromatic system when z is 2 or more. When there is no additional substituent of general formula II present in the ring system it is preferred that z is 2 or more.

The most preferred compounds of general formula I are those which may be represented by general formula III

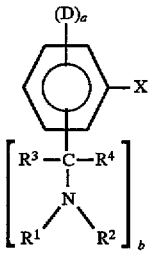

III wherein X represents hydrogen, or a hydrocarbyl group, or a non-hydrocarbyl group, or a group of general formula IV:

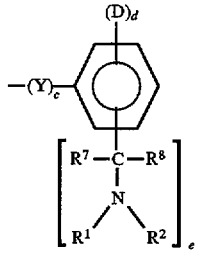

IV wherein Y is a divalent group and wherein a=1, 2, 3, 4 or 5, b=1, 2, 3 or 4, c=0, 1 or 2, d=0, 1, 2, 3 or 4 and e=0, 1, 2, 3 or 4 and wherein $R^3$, $R^4$, $R^7$ and $R^8$ are hydrogen or hydrocarbyl, and wherein, $R^1$ and $R^2$ are independently $C_{10}$–$C_{40}$ aliphatic hydrocarbyl groups. D represents a hydroxyl group or a derivative of a hydroxyl group. When D is a derivative of a hydroxyl group it is preferably a —O—C(O)—$CH_3$ group. The $C_{10}$–$C_{40}$ aliphatic hydrocarbyl groups may be linear or branched chains. It is preferred that the chains are linear.

When X is a group other than a group of formula IV preferably a=1 or 2 and b=1, 2, 3 or 4, most preferably a=1 or 2 and b=1, 2 or 3.

When X is a group of formula IV and c=0, preferably a=1, 2 or 3, b=1, 2 or 3, d=0, 1, 2 or 3, and e=0, 1, 2 or 3, most preferably a=1, b=1, d=1 and e=1.

When X is a group of formula IV and c=1, preferably a=1, 2 or 3, b=1, 2 or 3, d=0, 1, 2 or 3 and e=0, 1, 2 or 3, most preferably a=1 or 2, b=1 or 2, d=0, 1 or 2 and e=0, 1 or2.

In both formulas III and IV the benzene ring may be part of a larger ring system such as a fused polycyclic ring system or may be a heterocyclic ring or an aromatic ring other than benzene.

When c=1 groups III and IV may also be joined directly, as in when c=0, in addition to being joined by the divalent group Y. When c=2 the divalent groups Y may be the same or different.

Preferably $R^3$, $R^4$, $R^7$ and $R^8$ are hydrogen. The aliphatic hydrocarbyl groups $R^1$ and $R^2$, may be the same or different and are preferably independently $C_{10}$–$C_{40}$ alkyl groups. Desirably the alkyl groups are independently $C_{12}$–$C_{24}$ alkyl groups and most preferably $C_{16}$–$C_{22}$ alkyl groups. When there is more than one $R^1$ or $R^2$ group present they may be the same or different aliphatic hydrocarbyl groups. Preferred combinations of alkyl groups are those wherein $R^1/R^2$ are either $C_{16}/C_{18}$, $C_{20}/C_{22}$, $C_{18}/C_{18}$ or $C_{22}/C_{22}$.

The aliphatic hydrocarbyl groups may also contain hetero atoms such as O, N or S. It is preferred that no hetero atoms are present in the aliphatic hydrocarbyl groups and that the groups are linear or those which have low levels of branching.

The divalent group Y may be a substituted or unsubstituted aliphatic group such as for example methylene, —$C(CH_3)_2$—, —CH(Ph)—, a group of formula V or similar groups,

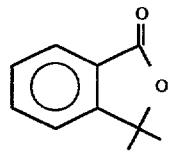

V or groups such as —C(O)—, —S(O)—, —$S(O)_2$—, —O—, —S—, —C(O)—O— and —C(O)—O—$R^{11}$—O—C(O)— wherein $R^{11}$ is a hydrocarbyl group as hereinbefore defined. When there are two divalent groups present i.e. when c=2 they may be the same or different e.g. the combination of the group of formula V and —O— as in fluorescein. The divalent group Y may also be an aromatic group. The divalent group Y may also contain activated cyclic rings which have the substituent group —(A—$NR^1R^2$) present in the cyclic ring.

The compounds of general formula III may also be substituted with one or more groups of general formula II. It is preferred that when X is a group other than that of formula IV and when b=1 that at least one group of general formula II is present in the compound of formula III. The compounds of general formula II may also be substituted with non-hydrocarbyl groups such as for example $NO_2$ or CN groups.

A second aspect of the invention is a compound of the formula I as defined above but wherein the activating group is a hydroxyl group.

A third aspect of the invention is a method of preparing the compounds of the second aspect of the invention wherein a compound with a hydroxyl-aromatic system, hereinafter referred to as an activated compound, formaldehyde or an aldehyde and a secondary amine which comprises independently $C_{10}$–$C_{40}$ aliphatic hydrocarbyl groups, are reacted together under Mannich condensation conditions.

The reactants may be used in equimolar or substantially equimolar proportions. The mole ratio of the activated compound to secondary amine may be less than equimolar for example 1:2, 1:3 or 1:4 or more. It is preferred that the mole ratio of activated compound to secondary amine is 1:2 or substantially 1:2 and that there is sufficient formaldehyde present to enable this mole ratio to be achieved in the final product.

The reaction may be carried out in a solvent for example toluene or without a solvent and at a temperature in the range of 80° C. to 120° C.

The aldehyde may be any aldehyde which reacts with an activated compound and a $C_{10}$–$C_{40}$ aliphatic hydrocarbyl secondary amine under Mannich condensation conditions. It is preferred that formaldehyde is used in the method. The formaldehyde may be employed in any of its conventional forms; it may be used in the form of an aqueous solution such as formalin, as paraformaldehyde or as trioxane.

Suitable hydroxyaromatic compounds include for example: substituted phenols such as 2-, 3-, or 4-hydroxybenzophenone, 2-, 3-, or 4-hydroxybenzoic acid and 1-, or 2-naphthol; dihydroxy compounds such as resorcinol, catechol, hydroquinone, 2,2'- biphenol, 4,4'biphenol, fluorescein, 2,2-bis(p-hydroxy phenyl) propane, dihydroxybenzophenones, 4,4'-thiodiphenol, or dihydroxy benzoic acids such as 2,4-, or 3,5-dihydroxybenzoic acid; or trisphenolic compounds such as 1,1,1-tris-(4-hydroxy phenyl)ethane. The hydroxy aromatic compounds may be substituted for example with one or more of the following substituents: no-hydrocarbyl groups such as —$NO_2$ or CN; or hydrocarbyl groups such as —CHO, —COOR, —COR, —COOR; or aliphatic hydrocarbyl groups such as alkyl groups. The substituent or substituents may be in the ortho, para or meta or any combination of these positions in relation to the hydroxyl group or groups. When the hydroxyaromatic compound is a substituted phenol it is preferred that the substitution is in the ortho or para position. Phenols which have certain para substituents have been found to produce bisdialkylaminomethyl Mannich reaction products, derived from secondary amines with aliphatic hydrocarbyl groups of $C_{10}$ to $C_{40}$, under milder reaction conditions and with greater ease than when using unsubstituted phenol. In some cases substitution in the ortho position also allows easier reaction under milder conditions, though some such substituents are not beneficial, such as those substituents which are able to hydrogen bond with the hydroxyl group. A suitable ortho substituent is a cyano group. It will be understood that with dihydroxy compounds such as catechol where two or more hydroxy groups are present in the same ring, that any one substituent may be ortho with respect to one of these hydroxy groups and meta in relation to the other.

The amine may be any secondary amine which contains linear and/or branched chain aliphatic hydrocarbyl groups of $C_{10}$–$C_{40}$, and preferably $C_{12}$–$C_{24}$ and most preferably $C_{16}$–$C_{22}$. Preferred secondary amines are linear or those which have low levels of branching.

Examples of suitable secondary amines include the simple secondary amines such as N,N-dihexadecylamine, N,N-dioctadecylamine, N,N-dieicosylamine, N,N-didocosylamine, N,N-dicetylamine, N,N-distearylamine, N,N-diarachidylamine, N,N-dibehenylamine, N,N-dihydrogenated tallow amine and mixed secondary amines which comprise a mixture of any two of the following functionality: hexadecyl, octadecyl, eicosyl, docosyl, cetyl, stearyl, arachidyl, behenyl or hydrogenated tallow or that derived from the fatty acids of coconut oil.

Additional substituents of general formula II may be formed on the aromatic system during the above reaction by reacting activated compounds which have a carboxylic acid group present, with the corresponding amount of amine to take part in the above reaction and also to neutralise the carboxylic acid groups present. Alternatively the carboxylic acid groups may be neutralised after the reaction by adding the required amount of amine, which may be the same or a different amine to that used in the reaction, to neutralise the carboxylic acid groups.

There may be an additional reaction stage to convert the activating group into a derivative of the activating group such as, for example, the conversion of a hydroxyl group to its acetate ester by reaction for example with acetic anhydride.

The oleaginous composition of the first aspect of the invention may comprise a crude oil, a lubricating oil or a fuel oil.

When the compounds of formula I are used in lubricating oil compositions which employ a base oil the concentration of the compound in the composition is typically in the range 0.01 to about 15% by weight based on the total weight of the composition and is preferably from about 0.1 to about 7% by weight based on the total weight of the composition. The base oils employed in the lubricating oil composition may be natural or synthetic base oils.

Suitable base oils for use in preparing lubricating compositions of the present invention include those conventionally employed as crankcase lubricating oils for spark-ignited and compression-ignited internal combustion engines, such as automobile and truck engines, marine and railroad diesel engines. Also envisaged are base oils conventionally employed in and/or adapted for use as power transmitting fluids such as automatic transmission fluids, tractor fluids, universal tractor fluids and hydraulic fluids, heavy duty hydraulic fluids, power steering fluids, gear lubricants, industrial oils, pump oils and other lubricating oil compositions.

The base oil may be a synthetic base oil such as for example alkyl esters of dicarboxylic acids, polyglycols and alcohols, polyalphaolefins, alkyl benzenes, organic esters of phosphoric acids, or polysilicone oils.

Suitable natural base oils include mineral lubricating oils which may vary widely as to their crude source, e.g. whether paraffinic, naphthenic, or mixed paraffinic-naphthenic; as well as to their formation, e.g. distillation range, straight run or cracked, hydrorefined, or solvent extracted.

More specifically, the natural lubricating oil base stocks which can be used in the compositions of this invention may be straight mineral lubricating oil or distillates derived from paraffinic, naphthenic, asphaltic or mixed base crudes, or, if desired, various blend oils may be employed as well as residuals, particularly those from which asphaltic constituents have been removed. The oils may be refined by conventional methods using acid, alkali, and/or clay or other agents such as aluminium chloride, or they may be extracted oils produced, for example, by solvent extraction with solvents such as phenol, sulphur dioxide, furfural, dichlorodiethyl ether, nitrobenzene and crotonaldehyde.

The lubricating oil base stock conveniently has a viscosity of typically about 2.5 to about 12, and preferably about 2.5 to about 9 centistokes at 100° C.

Preferably, the oleaginous compostion of the first aspect of the present invention is a fuel oil composition. In fuel oil compositions it is preferred that the composition comprises at least one of the compounds of formula I in a concentration of between 10 and 2000 ppm by weight of fuel, preferably 25 to 500 ppm, more preferably 100 to 500 ppm.

The fuel oil may be any liquid hydrocarbon fuel and is preferably a middle distillate fuel oil. Suitable distillate fuel oils include those which boil in the range 110°–500° C. (ASTMD86). Preferable distillate fuel oils may for example be an atmospheric distillate, a vacuum distillate, a straight run distillate or a fraction cracked either thermally or catalytically or a mixture of any two or more fuels. The most common petroleum distillate fuels are kerosene, jet fuels, diesel fuels and heating oils. Heating oil may be a straight atmospheric distillate, or it may frequently contain minor amounts e.g. 0 to 35% by weight of vacuum gas oil and/or cracked gas oils. Other suitable fuel oils include synthetic fuel oils and bio-fuel oils.

A further aspect of the invention is an oleaginous additive concentrate. The oleaginous additive concentrate may be a crude oil, a lubricating oil or a fuel oil additive concentrate. The concentrates of the present invention are convenient as a means for incorporating the additive into bulk oil such as distillate fuel, which incorporation may be done by methods known in the art.

The fuel oil additive concentrate may comprise 3 to 75% by weight, preferably 3 to 60% by weight, and most preferably 10 to 50% by weight of a compound of formula I in admixture with a fuel oil or a solvent which is miscible with fuel oils. The lubricating oil additive concentrate may comprise 10 to 80% by weight, preferably 20 to 60% by weight, of a compound of the present invention in admixture with a lubricating oil or a solvent which is miscible with lubricating oils.

A still further aspect of the invention is the use of compounds of formula I as additives for modifying the properties or performance of oleaginous materials including the modification of the properties or performance of fuel oils or lubricating oils.

Such use may be as a wax crystal modifier and/or a cold flow improver in a fuel oil, especially a middle distillate fuel oil, of a compound of formula 1.

The compounds of formula I may be used as the sole additive for the composition or additive concentrate. Two or more of the compounds may be used in conjunction with each other to produce a synergistic or additive effect. Improved results may be achieved by using the above specified compounds in association with other additives.

When the oleaginous composition or additive concentrate comprises a lubricating oil base stock the other additives may include viscosity modifiers, corrosion inhibitors, oxidation inhibitors, friction modifiers, other dispersants, anti-foaming agents, anti-wear agents, pour point depressants, detergents or rust inhibitors. When the oleaginous composition or additive concentrate comprises a fuel oil the other additives may include one or more wax crystal modifiers, wax crystal growth inhibitors, wax antisettling aids, low temperature or cold flow improvers and cloud point depressants, An example of such additional additives for fuel oils are polar compounds, either ionic or non-ionic, which have the capability in fuels of acting as wax crystal growth inhibitors. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing from 30 to 300 total carbon atoms. The nitrogen compound preferable contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, and hydrogenated tallow amine. Examples of secondary amines include dioctadecyl amine, methyl-behenyl amine and the like. Amine mixtures are also suitable and many amines derived from natural materials are mixtures. The preferred amine is a secondary hydrogenated tallow amine of the formula $HNR^{12}R^{13}$ wherein $R^{12}$ and $R^{13}$ are alkyl groups derived from hydrogenated tallow fat composed of approximately 4% $C_{14}$, 31% $C_{16}$, 59% $C_{18}$. Examples of suitable carboxylic acids for preparing these nitrogen compounds (and their anhydrides) include cyclo-hexane 1,2 dicarboxylic acid, cyclohexane dicarboxylic acid, cyclopentane 1,2 dicarboxylic acid and naphthalene dicarboxylic acid. Generally, these acids will have about 5–13 carbon atoms in the cyclic moiety. Preferred acids are benzene dicarboxylic acids such as phthalic acid, terephthalic acid and iso-phthalic acid. Phthalic acid or its anhydride is particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt. Other suitable nitrogen compounds are described in U.S. Pat. No. 4,402,708 and in references cited therein.

Other suitable additives for fuel oils to be used with the compounds of the present invention are the polyoxyalkylene esters, ethers, ester/ethers, amide/esters and mixtures thereof, particularly those containing at least one, preferably at least two $C_{10}$ to $C_{30}$ linear saturated alkyl groups of a polyoxyalkylene glycol of molecular weight 100 to 5000 preferably 200 to 5000, the alkyl group in said polyoxyalkylene glycol containing from 1 to 4 carbon atoms. European Patent Application 0 061 895 A2 describes some of these additives. Other such additives are described in U.S. Pat. No. 4,491,455.

The preferred esters, ethers or ester/ethers may be structurally depicted by the formula: $R^{14}$—O—(A)—O—$R^{15}$ where $R^{14}$ and $R^{15}$ are the same or different and may be:

(i) n-alkyl-, (ii) n-alkyl-C(O)—, or (iii) n-alkyl-O—C(O)—$(CH_2)_n$—, (iv) n-alkyl-O—C(O)—$(CH_2)_n$—C(O)—, the alkyl group being linear and saturated and containing 10 to 30 carbon atoms, and A represents the polyoxyalkylene segment of the glycol in which the alkylene group has 1 to 4 carbon atoms such as a polyoxymethylene, polyoxyethylene or polyoxytrimethylene moiety which is substantially linear; some degree of branching with lower alkyl side chains (such as in polyoxypropylene glycol) may be tolerated but it is preferred that the glycol should be substantially linear. A may also contain nitrogen.

Suitable glycols generally are the substantially linear polyethylene glycols (PEG) and polypropylene glycols (PPG) having a molecular weight of about 100 to 5,000, preferably about 200 to 2,000. Esters are preferred and fatty adds containing from 10–30 carbon atoms are useful for reacting with the glycols to form the ester additives and it is preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates when minor amounts of monoethers and monoesters (which are often formed in the manufacturing process) may also be present. It is important for additive performance that a major amount of the dialkyl compound is present. In particular, stearic or behenic diesters of polyethylene glycol, polypropylene glycol or polyethylene/polypropylene glycol mixtures are preferred. A particularly preferred additive at this type is polyethylene glycol dibehenate, the glycol portion having a molecular weight of about 600 and is often abbreviated as PEG 600 dibehenate. It has been found that the polar nitrogen containing compounds are especially effective when used with these glycol esters, ethers or ester/ethers. Examples of other compounds in this general category are those described in Japanese Patent Publication Nos 2-51477 and 3-34790 (Sanyo).

Other suitable additional additives for fuel oils to be used with the compounds of this invention are ethylene unsaturated ester copolymer flow improvers. The unsaturated monomers which may be copolymerised with ethylene include unsaturated mono and diesters of the general formula.

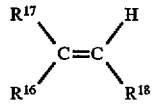

wherein $R^{17}$ is hydrogen or methyl; $R^{16}$ is a —$OOCR^{19}$ group wherein $R^{19}$ is hydrogen or a $C_1$ to $C_{28}$, more usually $C_1$ to $C_{17}$, and preferably $C_1$ to $C_8$, straight or branched chain alkyl group, or $R^{16}$ is a —$COOR^{19}$ group wherein $R^{19}$ is as previously defined but is not hydrogen; and $R^{18}$ is hydrogen or —$COOR^{19}$ as previously defined. The monomer, when $R^{16}$ and $R^{18}$ are hydrogen and $R^{17}$ is —$OOCR^{19}$, includes vinyl alcohol esters of $C_1$ to $C_{29}$, more usually $C_1$ to $C_5$ monocarboxylic acid, and preferably $C_2$ to $C_{29}$, and more usually $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. It is also preferred that the copolymers contain from 5 to 40 wt. % of the vinyl ester, more preferably from 10 to 35 wt. % vinyl ester. They may also be mixtures of two copolymers such as those described in U.S. Pat. No. 3,961,916. It is preferred that these copolymers have a number average molecular weight as measured by vapour phase osmometry of 1000 to 10000, preferably 1000 to 5000.

Other suitable additives for fuel oils to be used with the compounds of this invention are the comb polymers. Such polymers are discussed in "Comb-like polymers. Structure and Properties", N. A. Platé and V. P. Shibaev, J. Poly. Sci. Macromolecular Revs., 8, p.117 to 253 (1974). Advantageously, the comb polymer is a homopolymer, or a copolymer at least 25 and preferably at least 40, more preferably at least 50, molar per cent of the units of which have side chains containing at least 6, and preferably at least 10, atoms.

As examples of preferred comb polymers there may be mentioned those of the general formula:

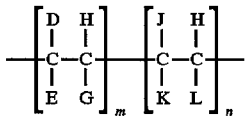

where

D=$R^{20}$, CO.$OR^{20}$, OCO.$R^{20}$, $R^{21}$CO.$OR^{20}$ or $OR^{20}$

E=H or $CH_3$ or D or $R^{21}$

G=H, or D m=1.0 (homopolymer) to 0.4 (mole ratio)

J=H, $R^{21}$, aryl or heterocyclic group, or $R^{21}$CO.$OR^{20}$

K=H, CO.$OR^{21}$, OCO.$R^{21}$, $OR^{21}$ or $CO_2H$

L=H, $R^{21}$, CO.$OR^{21}$, OCO.$R^{21}$. Aryl or $CO_2H$ n=0.0 to 0.6=1-m (mole ratio)

$R^{20}$=$C_{10}$ hydrocarbyl or higher $R^{21}$=$C_1$ hydrocarbyl or higher $R^{20}$ advantageously represents a hydrocarbyl group with from 10 to 30 carbon atoms, while $R^{21}$ advantageously represents a hydrocarbyl group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g. an α-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{21}$ refers to the average number of carbon atoms in the alkyl group; if alcohols that contain a branch at the 1 or 2 positions are used $R^{21}$ refers to the straight chain backbone segment of the alcohol.

These comb polymers may especially be fumarate or itaconate polymers and copolymers such as for example those described in European Patent Applications 153 176, 153 177 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight.

Other suitable comb polymers are the polymers and copolymers of α-olefins and esterified copolymers of styrene and maleic anhydride, and esterified copolymers of styrene and fumaric acid; and polymers of alkyl esters of itaconic acid or citraconic acid such as those where the alkyl groups have from 16 to 18 carbon atoms and the polymer has a number average molecular weight of from 1000 to 20000. Mixtures of two or more comb polymers may be used in accordance with the invention and, as indicated above, such use may be advantageous. Another monomer may be terpolymerized if necessary.

Other suitable additives for fuel oils to be used with the compounds of this invention are the hydrocarbon polymers such as those represented by the following general formula

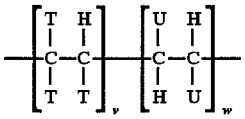

where

T=H or $R^{22}$

U=H, T or aryl v=1.0 to 0.0 (mole ratio)

w=0.0 to 1.0=1-v (mole ratio)

where $R^{22}$ is alkyl.

These polymers may be made directly from ethylenically unsaturated monomers or indirectly by hydrogenating the polymer made from monomers such as isoprene and/or butadiene.

Such polymers include copolymers of ethylene and at least one α-olefin, having a number average molecular weight of at least 30000. Preferably the α-olefin has at most 20 carbon atoms. Examples of such olefins are propylene, 1-butene, isobutene, n-octene-1, isoctene-1, n-decene-1, and n-dodecene-1. The copolymer may also comprise small amounts, e.g. up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30000, as measured by gel permeation chromatography (GPC) relative to polystyrene standards, advantageously at least 60000 and preferably at least 80000. Functionally no upper limit arises but difficulties of mixing result from increased viscosity at molecular weights above about 150000, and preferred molecular weight ranges are from 60000 and 80000 to 120000.

A particularly preferred hydrocarbon polymer is a copolymer of ethylene and propylene having an ethylene content preferably between 20 and 60% (w/w) and is commonly made by homogeneous catalysis.

The copolymers may be prepared by any of the methods known in the art, for example using a Ziegler type catalyst. The polymers should be substantially amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1000 to 6000, and preferably from 2000 to 5000, as measured by vapour phase osmometry. Appropriate α-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

Other suitable additives for fuel oils to be used with the compounds of this invention are sulphur carboxy compounds such as those described in EP-A-0 261 957 which describes the use of compounds of the general formula

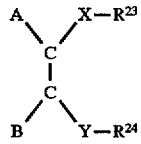

in which

—Y—$R^{24}$ is $SO_3(-)(+)NR_3^{25}R^{24}$, —$SO_3(-)(+)HNR_2^{25}R^{24}$ —$SO_3(-)(+)H_2NR^{25}R^{24}$, —$SO_3(-)(+)H_3NR^{24}$, —$SO_2NR^{25}R^{24}$ or —$SO_3R^{24}$;

—X—$R^{23}$ is —Y—$R^{24}$ or —$CONR^{25}R^{23}$, —$CO_2(-)(+)NR_3^{25}R^{25}$, —$CO_2(-)(+)HNR_2^{25}R^{23}$, —$R^{26}$—$COOR^{23}$, —$NR^{25}COR^{23}$, —$R^{26}OR^{23}$, —$R^{26}OCOR^{23}$, —$R^{26}$, $R^{23}$, —$N(COR^{25})R^{23}$ or $Z(-)(+)NR_3^{25}R^{23}$;

—Z(−) is $SO_3(-)$ or —$CO_2(-)$;

$R^{23}$ and $R^{24}$ are alkyl, alkoxy alkyl or polyalkoxyl alkyl containing at least 10 carbon atoms in the main chain; $R^{25}$ is hydrocarbyl and each $R^{25}$ may be the same or different and $R^{26}$ is nothing or is $C_1$ to $C_5$ alkylene and in

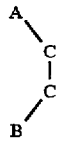

the carbon—carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X—$R^{23}$ and Y—$R^{24}$ between them contain at least three alkyl, alkoxyalkyl or polyalkoxyalkyl groups.

Other suitable additives for fuel oils to be used with the compounds of the invention are dialkylaminomethylbenzene compounds of the general formula;

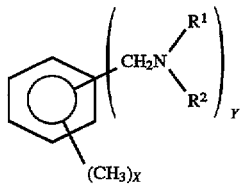

Wherein X may be 0,1,2 or 3, and Y may be 2, 3 or 4, and $R^1$ and $R^2$ have the same meaning as above.

Such compounds may be prepared by the reaction of secondary amines with the appropriate acid chlorides such as methylisophthaloyl chloride followed by reduction of the resulting diamide with lithium aluminium hydride.

Other suitable additives for fuel oils include the block copolymers described in PCT Publication numbers WO91/11469 and WO91/11488 which improve the cold flow properties of distillate fuels; the co-polymer additives described in EP 0 306 290 A1, which improve the cold flow properties of distillate fuels and lubricating oils; the amido-amine adducts as described in EP 0 336 664 A2; the lactone-modified Mannich bases described in EP 0 304 175 A1, or the lactone modified materials as described in EP 0 263 703 A2.

The invention will now be further illustrated by means of the following examples:

EXAMPLE 1

Ten additives were prepared using combinations of one of the following hydroxyaromatic compounds, 2,2'-biphenol, 4,4'-biphenol or 2,2-bis(hydroxyphenyl) propane (bisphenol A) in conjunction with one of the following secondary amines; N-hexadecyl-N-octadecyl amine ($C_{16}/C_{18}$) (dihydrogenated tallowamine), N,N-dioctadecylamine, ($C_{18}/C_{18}$) N-eicosenyl-N-docosanyl amine ($C_{20}/C_{22}$) or N,N-didocosylamine ($C_{22}/C_{22}$) and by means of the following general reaction procedure.

Reaction Procedure

To a mixture of 10 g (2 molar equivalents) of dihydrogenated tallow amine and 2.28 g (1 molar equivalent) of bisphenol A in toluene (50 mls) at 80° C. was added 0.66 g (2.2 molar equivalents) of paraformaldehyde and the resulting mixture kept at this temperature for 2 hours. The mixture was refluxed for 30 minutes and then evaporated under reduced pressure to give a waxy solid of the desired product. The n.m.r. spectra of all the samples prepared by this procedure were consistent with one of the following structures, A, B or C.

A

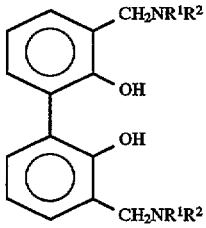

-continued

B

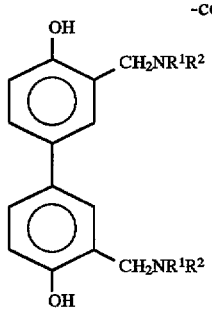

C

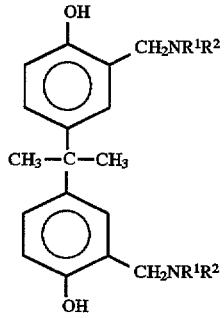

Evaluation of Additives

All of these additive compounds were tested for their ability to act as wax crystal modifiers and to improve the filterability of distillate fuels namely a fuel characterised below at −14° C. using the flow improver Extended Programmed Cooling Test (XPCT).

The characteristics of the fuel were:

| | |
|---|---|
| IBP | 145.0° C. |
| FBP | 366.6° C. |
| CP | −5° C. |
| WAT | −6.2° C. |
| Wax (at 10° C. below CP) | 1.64% |

wherein CP means "Cloud Point", WAT means "Wax Appearance Temperature", IBP means "Initial Boiling Point" and FBP means "Final Boiling Point". The fuel had been pre-treated with 50 ppm of a commercially available ethylene/vinyl acetate copolymer to give a base XPCT pass of 80#.

The flow improver Extended Programmed Cooling Test (XPCT) is a slow cooling test designed to indicate whether wax in a distillate fuel will pass through filters such as those which are found in heating oil distribution systems.

In the test, the cold flow properties of the above fuel containing the additive compounds were determined as follows: 200 $cm^3$ of the fuel in a bottle was cooled linearly at 1° C./hour to the test temperature and the temperature then held constant. After 2 hours at −14° C., wax which had settled in the bottle was dispersed by gentle stirring. At this point a Cold Filter Plugging Point (CFPP) assembly was inserted; the CFPP assembly is described in detail in "Journal of the Institute of Petroleum" Volume 52, Number 510, June 1966 pp 173–285. The tap of the CFPP assembly was then opened to apply a vacuum of 500 mm of mercury and closed when 200 $cm^3$ of fuel had passed through a filter in the CFPP assembly into a graduated receiver. A pass is recorded if the 200 $cm^3$ of fuel will pass through a given mesh size within 2 minutes or a fail is recorded if the filter has become blocked.

During the test a series of CFPP filter assemblies were used, with filter screens of 10μ to 45μ including LTFT (AMS 100.65) and a Volkswagen (VW) Tank filter (part no. KN4-270/65.431-201-511) both intermediate between 30 and 40μ, in order to determine the finest mesh the fuel will pass. The following filters were used 80#, 100#, 120#, 150#, 200#, 250#, VW, 350#, LTFT, 500#, 25μ, 20μ and 15μ.

As a comparison the fuel was tested with the addition of a commercially available ethylene/vinyl acetate copolymer additive at a concentration of 250 ppm; this comparative sample gave a VW pass with the XPCT test. The results are illustrated in Table 1 indicating the smallest filter which was passed with each additive.

The results show that in general the additives of the invention improve the XPCT performance of the base fuel oil. In most cases they are as good as or are superior to the commercially available ethylene/vinyl acetate copolymer additive used as a comparison.

EXAMPLE 2

Additives 6 and 10 as prepared in Example 1 were evaluated in a fuel characterised below in combination with one or more of the following additives.

A. A mixture of two ethylene/vinyl acetate copolymers comprising 13 parts by weight of a first copolymer and 1 part by weight of a second and different copolymer.

B. A homopolymer of an ester of itaconic acid having linear alkyl groups of $C_{16}$ carbon atoms made by polymerising the monomer using a free radical catalyst, the homopolymer having an $M_n$ of 4000.

C. A homopolymer of an ester of itaconic acid having linear alkyl groups of $C_{18}$ carbon atoms made by polymerising the monomer using a free radical catalyst, the homopolymer having an $M_n$ of 4000.

D. An amide/amine salt from the reaction of phthalic anhydride and two moles of dihydrogenated tallow amine.

E. An additive which is the 3-nitro derivative of Additive D.

F. A dialkylaminomethylbenzene compound of the following structure:

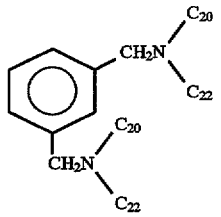

this compound having been prepared by the reaction of isophthaloyl chloride with two equivalents of a $C_{20}/C_{22}$ secondary amine followed by reduction of the resulting diamide with aluminium lithium hydride.

The characteristics of the fuel were:

| | |
|---|---|
| IBP | 140° C. |
| 5% | 188° C. |
| 10% | 198° C. |
| 20% | 208° C. |
| 30% | 221° C. |
| 40% | 235° C. |
| 50% | 251° C. |
| 60% | 269° C. |
| 70% | 288° C. |
| 80% | 310° C. |
| 90% | 334° C. |
| 95% | 354° C. |
| FBP | 360° C. |

-continued

| | |
|---|---|
| CP | −3° C. |
| WAX (at 10° C. below CP) | 2.4% |

Combinations of these additives were evaluated using the XPCT method described in Example 1. The results are illustrated in Table 2 which indicates the finest filter passed by each sample.

The results indicate that in nearly all of the compositions the addition of additive No. 6 or No. 10 further improves the cold flow performance of the fuel which contains one or more of additives A to F.

EXAMPLE 3

Various additives were prepared from either ortho or para substituted phenols in conjunction with $C_{16}$–$C_{22}$ secondary amines using the general reaction procedure as described in Example 1. These additives were prepared under relatively mild reaction conditions. The additives were tested in the fuel characterised in Example 1 at −14° C. using the XPCT method as described in Example 1.

The results are illustrated in Table 3 indicating the smallest filter which was passed with each additive. The results clearly indicate that these additives improve the cold flow performance of this base fuel oil.

EXAMPLE 4

Various additives were prepared from the dihydroxybenzene compounds, resorcinol, catechol, hydroquinone, and 2-methylresorcinol in conjunction with $C_{16}$–$C_{22}$ secondary amines using the general reaction procedure as described in Example 1. For some additives the amount of secondary amine and formaldehyde were increased in order to produce tri substituted compounds. These additives were tested in the fuel characterised in Example 1 at −14° C. using the XPCT method as described in Example 1. The results are illustrated in Table 4 indicating the smallest filter which was passed with each additive.

EXAMPLE 5

Additive compounds were prepared by subjecting compounds of formulas No 2 and No 3 of Example 4 to the following reaction procedure with acetic anhydride to give the corresponding diacetate derivatives.

Reaction Procedure

To compound 3 of Example 4 (which contained $C_{20/22}$ dialkylamino groups) (1 g, 1 molar equivalent) in toluene (7 $cm^3$) at 80° C. was added acetic anhydride (0.25 g, 3 molar equivalents) and 4-(dimethylamino)pyridine (30 mg) and the mixture kept at 80° C. for one hour. The solvent was evaporated under reduced pressure to give the diacetylated derivative of the compound.

These additives were tested in the fuel characterised in Example 1 at −14° C. using the XPCT method as described in Example 1. The results are illustrated in Table 5 indicating the smallest filter which was passed with each additive.

EXAMPLE 6

Various additives were prepared from hydroxy and dihydroxybenzoic acids in conjunction with $C_{16}$–$C_{22}$ secondary amines using the reaction procedure as detailed in Example 1 to produce mono- or tris-dialkylaminomethyl substituted hydroxy and dihydroxybenzoic acid derivatives. In addition some of these substituted benzoic acids were treated with a further amount of the same or a different secondary amine to neutralise the benzoic acid and produce an ammonium salt of the acid; the neutralisation is typically carried out in the above reaction solvent at 80° C.

These additives were tested in the fuel characterised in Example 1 at −14° C. using the XPCT method as described in Example 1. The results are illustrated in Table 6 indicating the smallest filter which was passed with each additive.

Various additives were prepared from either fluorescein, 2,2'-dihydroxybenzophenone, 1,1,1-tris (4-hydroxyphenyl) ethane or 4,4'-thiodiphenol in conjunction with $C_{16}$–$C_{22}$ secondary amines using the reaction procedure as detailed in Example 1. These additives were tested in the fuel characterised in Example 1 at −14° C. using the XPCT method as described in Example 1. The results are illustrated in Table 7 indicating the smallest filter which was passed with each additive.

TABLE 1

| Additive | | | Concentration of Additive (ppm) | | |
|---|---|---|---|---|---|
| No | Hydroxyaromatic | Amine | 125 | 250 | 500 |
| 1 | 4,4'-Biphenol | $C_{16/18}$ 1:2 mix | 80# | 80# | 80# |
| 2 | 4,4'-Biphenol | $C_{18/18}$ mix | VW | VW | VW |
| 3 | 4,4'-Biphenol | $C_{20/22}$ 1:2 mix | LTFT | LTFT | VW |
| 4 | 2,2'-Biphenol | $C_{16/18}$ 1:2 mix | 80# | 80# | 80# |
| 5 | 2,2'-Biphenol | $C_{18/18}$ | VW | LTFT | VW |
| 6 | 2,2'-Biphenol | $C_{20/22}$ 1:2 mix | VW | 25 μ | 20 μ |
| 7 | Bisphenol A | $C_{16/18}$ 1:2 mix | 120# | 120# | 150# |
| 8 | Bisphenol A | $C_{18/18}$ | VW | VW | LTFT |
| 9 | Bisphenol A | $C_{20/22}$ 1:2 mix | 500# | 20 μ | 15 μ |
| 10 | Bisphenol A | $C_{22/22}$ | 500# | 15 μ | 15 μ |

TABLE 2

| Composition | Concentration of Additive in ppm | | | | | | | | XPCT Result |
|---|---|---|---|---|---|---|---|---|---|
| | A | B | C | D | E | F | No. 6 | No. 10 | Filter Passed |
| 1 | 200 | — | — | — | — | — | — | — | 80# |
| 2 | 200 | — | — | — | — | — | 100 | — | 100# |
| 3 | 200 | — | — | — | — | — | 200 | — | 150# |
| 4 | 200 | — | — | — | — | — | — | 100 | 120# |
| 5 | 200 | — | — | — | — | — | — | 200 | 120# |
| 6 | 200 | 100 | 100 | — | — | — | — | — | 80# |
| 7 | 200 | 100 | 100 | — | — | — | 100 | — | 350# |
| 8 | 200 | 100 | 100 | — | — | — | 200 | — | 350# |
| 9 | 200 | 100 | 100 | — | — | — | — | 100 | 350# |
| 10 | 200 | 100 | 100 | — | — | — | — | 200 | 350# |
| 11 | 200 | 100 | 100 | 200 | — | — | — | — | 500# |
| 12 | 200 | 100 | 100 | 200 | — | — | 100 | — | 15μ |
| 13 | 200 | 100 | 100 | 200 | — | — | — | 100 | 20μ |
| 14 | 200 | — | — | — | 200 | — | — | — | 80# |
| 15 | 200 | — | — | — | 200 | — | 100 | — | 80# |
| 16 | 200 | — | — | — | 200 | — | — | 100 | 350# |
| 17 | 200 | 100 | 100 | — | 100 | — | — | — | 350# |
| 18 | 200 | 100 | 100 | — | 100 | — | 100 | — | 15μ |
| 19 | 200 | 100 | 100 | — | 100 | — | — | 100 | 20μ |
| 20 | 200 | 100 | 100 | — | — | 100 | — | — | 350# |
| 21 | 200 | 100 | 100 | — | — | 100 | 100 | — | 25μ |
| 22 | 200 | 100 | 100 | — | — | 100 | 200 | — | 20μ |
| 23 | 200 | 100 | 100 | — | — | 100 | — | 100 | 500# |
| 24 | 200 | 100 | 100 | — | — | 100 | 100 | 100 | 15μ |

TABLE 3

| Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|
| 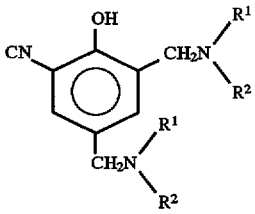 | 50 | 80# | — | 500# | VW |
| | 125 | 100# | 120# | 500# | 350# |
| | 250 | VW | VW | 500# | 350# |
| | 500 | — | LTFT | — | — |
| 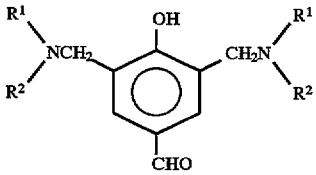 | 50 | 80# | — | VW | LTFT |
| | 125 | 80# | 150# | LTFT | 25μ |
| | 250 | 100# | 500# | 500# | 350# |
| | 500 | — | 500# | — | — |
| 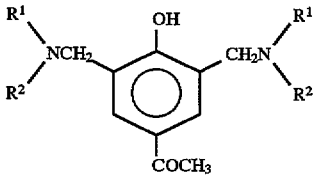 | 50 | 80# | — | LTFT | 350# |
| | 125 | 100# | 120# | 500# | 350# |
| | 250 | 120# | 500# | 25μ | 350# |
| | 500 | — | LTFT | — | — |

TABLE 3-continued

| Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|
| 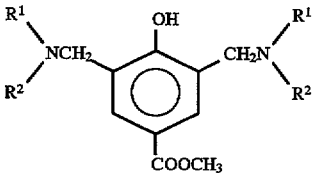 | 50<br>125<br>250<br>500<br>1000 | 80#<br>100#<br>VW<br>350#<br>VW | —<br>150#<br>LTFT<br>500#<br>— | LTFT<br>500#<br>350#<br>—<br>— | 350#<br>25μ<br>LFIF<br>—<br>— |
| 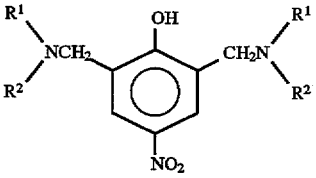 | 50<br>125<br>250<br>500 | 80#<br>80#<br>100#<br>ab,4 | —<br>VW<br>500#<br>500# | 100<br>VW<br>350#<br>— | 350#<br>20μ<br>VW<br>— |
| 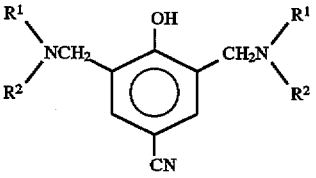 | 50<br>125<br>250<br>500 | 80#<br>100#<br>200#<br>— | —<br>200#<br>500#<br>500#<br>— | LTFT<br>500#<br>25μ<br>— | 350#<br>500#<br>VW<br>— |
| 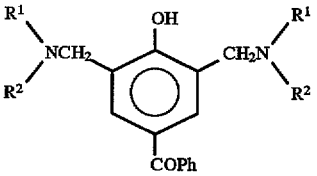 | 50<br>125<br>250<br>500 | 80#<br>100#<br>VW<br>— | —<br>VW<br>LTFT<br>LTFT | LTFT<br>500#<br>15μ<br>— | VW<br>20μ<br>15μ<br>— |

TABLE 4

| No. | Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|---|
| 1. | 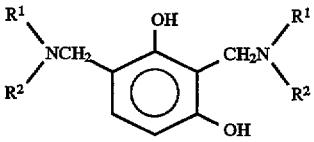 | 50<br>125<br>250 | —<br>100#<br>100# | —<br>—<br>— | VW<br>VW<br>VW | 350#<br>25μ<br>20μ |
| 2. | 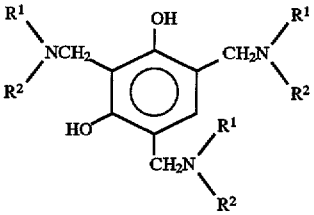 | 50<br>125<br>250 | 100#<br>100#<br>100# | 100#<br>VW<br>350# | 25μ<br>15μ<br>15μ | 500#<br>500#<br>15μ |
| 3. | 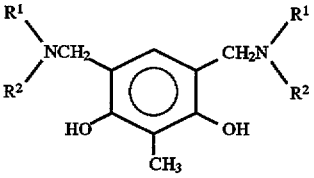 | 50<br>125<br>250 | 80#<br>80#<br>80# | 120#<br>150#<br>VW | 150#<br>200#<br>VW | 150#<br>200#<br>VW |

TABLE 4-continued
| No. | Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|---|
| 4. | 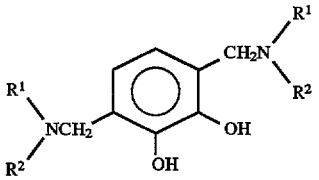 | 50 | — | 150# | 200# | 500# |
| | | 125 | 120# | 150# | 25μ | 20μ |
| | | 250 | 150# | 150# | 25μ | 15μ |
| | | 500 | VW | — | — | — |
| 5. | 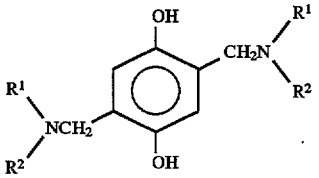 | 50 | — | — | — | 250# |
| | | 125 | 120# | — | — | 350# |
| | | 250 | 150# | — | — | 200# |
| | | 500 | VW | — | — | — |
TABLE 5
| Compound | Conc. (ppm) | Amino Functionality $R_1/R_2$ 18/18 | 20/22 (2:1 mix) | 20/22 (1:2 mix) |
|---|---|---|---|---|
| 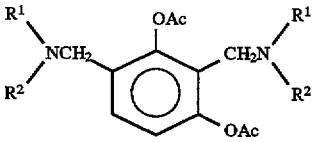 | 50 | — | — | VW |
| | 125 | — | — | 25μ |
| | 250 | — | — | 15μ |
| 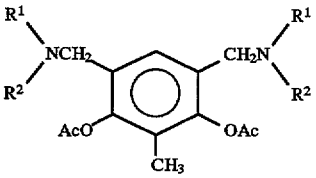 | 50 | 120# | 150# | 350# |
| | 125 | 120# | 200# | 20μ |
| | 250 | 120# | 500# | 25μ |
TABLE 6
| Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|
| 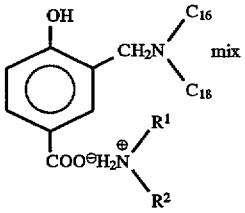 | 50 | 80# | 350# | 350# | 350# |
| | 125 | 150# | 350# | 350# | 350# |
| | 250 | 100# | 350# | 350# | 350# |

TABLE 6-continued

| Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|
| 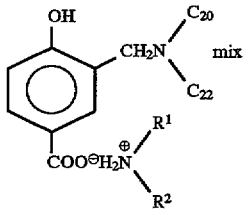 | 50<br>125<br>250 | VW<br>350#<br>VW | VW<br>VW<br>VW | VW<br>200#<br>VW | 350#<br>200#<br>150# |
| 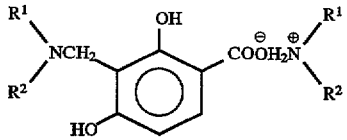 | 50<br>125<br>250 | VW<br>350#<br>VW | 200#<br>500#<br>500# | VW<br>350#<br>LTFT | VW<br>VW<br>350# |
| 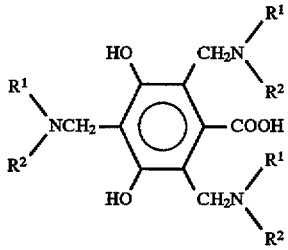 | 50<br>125<br>250 | VW<br>LTFT<br>LTFT | 25μ<br>500#<br>500# | VW<br>350#<br>25μ | LTFT<br>500#<br>500# |
| 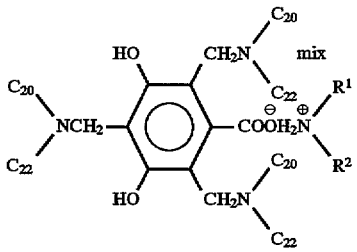 | 50<br>125<br>250 | 500#<br>500#<br>20μ | 500#<br>500#<br>20μ | 500#<br>350#<br>VW | 350#<br>350#<br>350# |
| 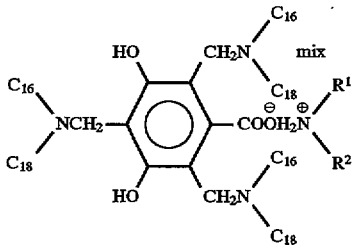 | 50<br>125<br>250 | 500#<br>500#<br>LTFT | 350#<br>LTFT<br>350# | LTFT<br>LTFT<br>350# | LTFT<br>LTFT<br>350# |
| 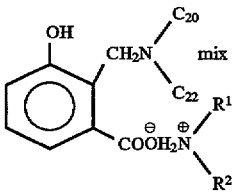 <br>and 4 substituted derivative | 50<br>125<br>250 | 350#<br>200#<br>LTFT | LTFT<br>500#<br>LTFT | 500#<br>500#<br>350# | 500#<br>LTFT<br>500# |

TABLE 7

| Compound | Conc. (ppm) | Amino Functionality $R_1/R_2$ 16/18 (1:2 mix) | 18/18 | 20/22 (2:1 mix) | 20/22 (1:2 mix) |
|---|---|---|---|---|---|
| 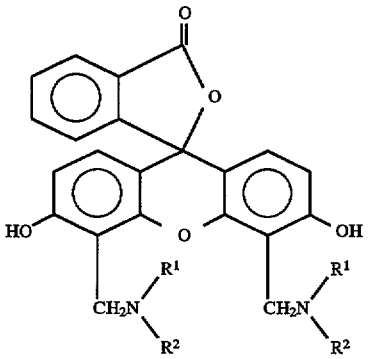 | 50 | 100# | — | 120# | VW |
| | 125 | 80# | — | 200# | 500# |
| | 250 | 80# | — | 120# | 15μ |
| 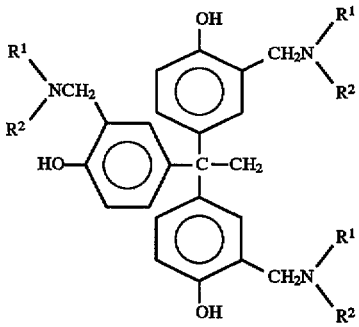 | 50 | 80# | — | 120# | 200# |
| | 125 | 80# | — | 150# | VW |
| | 250 | 100# | — | 350# | LTFT |
| | | — | | — | |
| 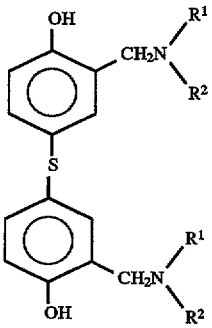 | 50 | 80# | — | 100# | VW |
| | 125 | 80# | — | 120# | 350# |
| | 250 | 80# | — | VW | 500# |
| 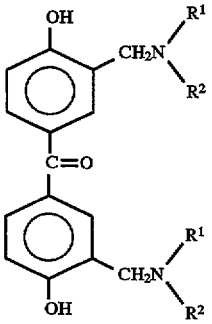 | 50 | 80# | — | — | — |
| | 125 | 80# | VW | — | 350# |
| | 250 | 100# | 500# | — | 500# |
| | 500 | — | 500# | — | LTFT |

We claim:

1. A composition comprising a middle distillate fuel oil containing 10 to 2000 ppm of an additive, effective to act as a wax crystal modifier and improve the filterability of the fuel, the additive consisting essentially of (i) a compound having the formula I, or a salt thereof:

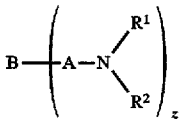

wherein B represents a polycyclic aromatic system selected from the group of naphthalene, anthracene, phenanthrene, pyrene, azulene, indene, hydroindene, fluorene, diphenylene, diphenyl, quinoline, indole, 2:3-dihydroindole, benzofuran, benzothiophen, carbazole, thiophenylamine, bisphenol A and fluorescein. A represents a hydrocarbyl group, $R^1$ and $R^2$ are the same or are different and each independently is an aliphatic group having 12–24 carbon atoms and being alkyl, alkylene, monoalkoxyalkyl or polyalkoxyalkyl or aliphatic groups which contain heteroatoms selected from O, N or S provided that one of $R^1$ and $R^2$ may represent a hydrogen atom, z is at least 2 and wherein the aromatic system carries at least one substituent group being either an hydroxyl or $OC(O)CH_3$ group, and (ii) one or more cold flow improvers comprising a polar N compound, a comb polymer, a polyoxyalkylene ester, ether, ester/ether, amide/ester, an ethylene-unsaturated ester copolymer, a hydrocarbon polymer or a sulphur carboxy compound, provided that additive componenet (ii) is different from additive component (i).

2. A composition as claimed in claim 1 wherein additive component (ii) is an ethylene-unsaturated ester copolymer flow improver.

3. A composition as claimed in claim 1 or claim 2 wherein the aromatic system also carries a substituent of the formula II:

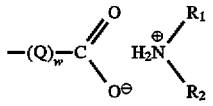

II wherein $R^1$ and $R^2$ are as defined in claim 1; Q represents a hydrocarbyl group; and w is 0 or 1.

4. A composition as claimed in claim 1 or 2 wherein A represents a methylene group.

5. A composition as claimed in claim 1 wherein the compound of formula I has the formula III:

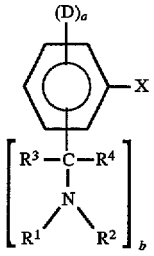

III wherein X represents hydrogen, or a hydrocarbyl group having 12–24 carbon atoms or a group of formula IV:

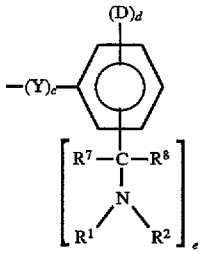

IV wherein Y is a divalent group and wherein a=1, 2, 3, 4, b=1, 2, 3 or 4, c=0, 1, or 2, d=0, 1, 2, 3 or 4, and e=0, 1, 2, 3 or 4 and wherein $R^3$, $R^4$, $R^7$ or $R^8$ are hydrogen or a hydrocarbyl group and wherein $R^1$, or $R^2$, are independently $C_{10}$–$C_{40}$ aliphatic hydrocarbyl groups and wherein D is a hydroxyl group or a —O—C(O)—$CH_3$ group.

6. A composition as claimed in claim 5 wherein $R^3$, $R^4$, $R^7$ and $R^8$ are hydrogen.

7. A composition as claimed in claim 1 wherein $R^1$ or $R^2$ are independently $C_{16}$ to $C_{22}$ aliphatic groups.

8. A composition as claimed in claim 1 wherein the additive component is present in a proportion of from 25 to 500 ppm by weight.

9. A composition as claimed in claim 1 wherein the additive component is present in a proportion of from 100 to 500 ppm by weight.

* * * * *